US005584258A

United States Patent [19]

del Castillo

[11] Patent Number: 5,584,258

[45] Date of Patent: Dec. 17, 1996

[54] SEMI-AUTOMATIC POCKET AND POCKET FLAP SETTER

[75] Inventor: Fernando del Castillo, Brownsville, Tex.

[73] Assignee: Ideal Equipment Company, Ltd., Montreal, Canada

[21] Appl. No.: 370,780

[22] Filed: Dec. 23, 1994

[51] Int. Cl.[6] ..... D05B 21/00; D05B 39/00

[52] U.S. Cl. ..... 112/470.07; 112/470.16; 112/470.18; 112/114

[58] Field of Search ..... 112/470.16, 470.07, 112/470.18, 470.33, 311, 320, 104, 113, 114, 141, 147, 148, 475.04, 475.06, 475.09, 475.08; 223/37, 38

[56] References Cited

U.S. PATENT DOCUMENTS 5,218,915 6/1993 Iwasaki et al. ..... 112/470.07

5,272,994 12/1993 Scholl et al. ..... 112/470.18

5,421,278 6/1995 Del Castillo ..... 112/470.18

5,493,981 2/1996 Del Castillo ..... 112/470.33

*Primary Examiner*—Peter Nerbun

*Attorney, Agent, or Firm*—G. Turner Moller

[57] ABSTRACT

A semiautomated sewing station sets a pocket blank and a pocket flap on a shirt panel in an integrated operation. The pocket blank is handled and sewn in a conventional manner. A transfer clamp used to move the shirt panel and pocket blank includes a holder for a pocket flap. After the pocket blank is sewn to the shirt panel, a shirt holder fixes the shirt panel relative to the sewing needle and the transfer clamp is moved by a conventional x-y positioner to place the pocket flap in its customary position over the top of the open pocket. The shirt panel is then released for movement relative to the sewing needle as the transfer clamp again moves the shirt panel relative to the sewing needle for stitching the pocket flap to the shirt panel. In this manner, the x-y positioner is used to place the pocket flap rather than a separate mechanism.

17 Claims, 3 Drawing Sheets

SEMI-AUTOMATIC POCKET AND POCKET FLAP SETTER

This invention relates to a work station where sewing operations are conducted on a textile workpiece and, more particularly, to a work station for setting a pocket and a pocket flap on a shirt panel.

BACKGROUND OF THE INVENTION

The manufacture of shirts has changed from a wholly hand manipulated, machine sewing operation to a series of work stations where parts of the garment are made in a more-or-less semiautomated manner. These parts are then assembled in a hand manipulated, machine sewing operation. This change has reduced the labor content of shirts so that much of the manufacturing operation has returned to the better developed countries from underdeveloped countries where labor costs are quite low.

Perhaps the most successful semi-automatic work station is a machine that sets a pocket blank on a shirt panel. Exemplary state of the art pocket setting machines are found in publications of applicant's assignee. These machines comprise a smooth stainless steel horizontal table on which a shirt blank is placed, a die blade where the pocket blank is placed by the machine operator, a folding group for tucking the edges of the pocket blank under the die blade, a sewing head, a transfer clamp that is moved by an x-y positioner and suitable electronic controls to actuate the die blade, the folding group, the x-y positioner and the sewing machine at the appropriate time and in the appropriate manner. The machine operator places a shirt panel in an appropriate position on the table under the die blade and puts the pocket blank under clips on the die blade. The machine is actuated so the die blade moves downwardly against the shirt panel and the folding group moves against the die blade, tucks the edges of the pocket blank under the die blade and then lifts out of the way. The transfer clamp moves to a position above the die blade and pushes the pocket blank and the shirt panel against the table. The die blade retracts and the transfer clamp is moved by the x-y positioner to a location under the needle of the sewing head. The sewing head drives the needle as the x-y positioner moves the transfer clamp in a predetermined path so the stitch pattern is as desired. While sewing is going on, the machine operator assembles another shirt panel and pocket blank. The sewing head cuts the thread from the assembled pocket and shirt panel and the process repeats.

Some shirt designs include a pocket flap sewn to the shirt panel at a location above the open top of the pocket. The pocket flap may incorporate a fastener, such as a button or snap, to secure the pocket flap to the pocket. Until very recently, pocket flaps were manually sewn to the shirt. This requires a series of separate operations: (1) the shirt panel is marked in some fashion to designate the location of the pocket flap, (2) the shirt panel having the pocket sewn thereon is transported to a manual work station, (3) the pocket flap is delivered to the same manual work station and (4) the flap is manually sewn to the shirt panel.

There has recently been introduced a machine to set a pocket flap on a shirt panel as an adjunct to a pocket setting operation. In this device, a complicated mechanism is provided on the transfer clamp of the pocket setting machine at a location above, but adjacent, the open top of the pocket. The machine operator puts a pocket blank in the work holder and the folding group tucks the edges of the pocket blank under the die blade. The transfer clamp moves to the work holder and the pocket flap is placed in a holder on the transfer clamp. The transfer clamp is moved by an x-y positioner to the sewing head where the pocket is sewn to the shirt panel. After the pocket is sewn, and with the shirt panel stationary, the pocket flap is moved downwardly toward the open top of the pocket by an assembly of air cylinders to its normal position above the pocket and then sewn. While the sewing is going on, the machine operator assembles another shirt panel and pocket blank. The sewing head cuts the thread from the assembled pocket and shirt panel and the process repeats.

This mechanism is complicated and expensive because the flap blank is moved from its retracted position on the transfer clamp to its normal position relative to the pocket by a complicated mechanism using a series of air cylinders. In addition, there is always a positioning problem when moving a work holder with air cylinders so there is always an adjustment problem leading to poor quality workmanship because the pocket flaps are prone to be mispositioned relative to the pocket. In addition, when switching from one style to another, the mechanism for holding and moving the pocket flap may require replacement or adjustment.

SUMMARY OF THE INVENTION

In this invention, a pocket flap is set onto a shirt panel in the same operation that the pocket blank is set onto the shirt panel. The transfer clamp is modified to accept a pocket flap at a location below the closed bottom of the pocket blank. The pocket blank is placed adjacent the shirt panel and a folding group tucks the edges of the pocket blank between a die blade and the shirt panel in a conventional manner.

The pocket flap is loaded onto the transfer clamp when it has been moved by the x-y positioner to the work holder. The transfer clamp pushes the pocket and shirt panel against the table top and the die blade retracts out of the pocket. The x-y positioner moves the transfer clamp to the sewing head thereby moving the shirt panel, pocket blank and pocket flap. The x-y positioner moves the transfer clamp in a predetermined path under the sewing needle while the transfer clamp pushes the shirt panel and pocket blank against the smooth work table so the pocket blank is sewn to the shirt panel in a predetermined manner depending on the software instructions to the x-y positioner.

A shirt panel holder is then actuated to fix the shirt panel relative to the table. The transfer clamp is moved upwardly out of pressing engagement with the work table and the x-y positioner moves the transfer clamp to a position where the pocket flap is correctly positioned relative to the pocket and shirt panel. The shirt panel holder is retracted to free the shirt panel for movement relative to the work table and the transfer clamp pushes downwardly on the shirt panel. The x-y positioner moves the transfer clamp in a predetermined path under the sewing needle while the transfer clamp pushes the shirt panel against the smooth work table so the pocket flap is sewn to the shirt panel.

This technique has a variety of advantages. First, locating the pocket flap holder on the transfer clamp below the pocket blank makes it easier and quicker to load the pocket flap in its holder. Second, positioning the pocket flap relative to the shirt panel and pocket is done by the x-y positioner and not some additional mechanism. This is very important for several reasons: (1) this requires only a simple technique to fix the shirt panel relative to the work table at the appropriate time thereby eliminating many complicated and expensive components of the prior art, (2) the pocket flap is positioned within the accuracy of the x-y positioner which is a fraction of a millimeter rather than to the accuracy of an air cylinder, and (3) adjustments between pocket flap designs can be accommodated by changing the software controlling the x-y positioner rather than replacing or adjusting some mechanical mechanism.

This invention is accordingly capable of setting a pocket flap in the same operation as setting a pocket at a minimum capital cost, with a high degree of accuracy as provided by the x-y positioner, with a very modest increase in cycle time of the pocket setting operation and with the capability of rapidly adjusting the device to accommodate pocket flaps of different style.

It is accordingly an object of this invention to provide a pocket setting machine having an improved pocket flap setting attachment.

Another object of this invention is to provide an improved pocket and pocket flap setter which relies on the existing x-y positioner for locating the pocket flap in its desired position.

A further object of this invention is to provide an improved pocket and pocket flap setter which is inexpensive to make and simple to operate and maintain.

Other objects and advantages of this invention will become more fully apparent as this description proceeds, reference being made to the accompanying drawings and appended claims.

DETAILED DESCRIPTION

Figure 1:
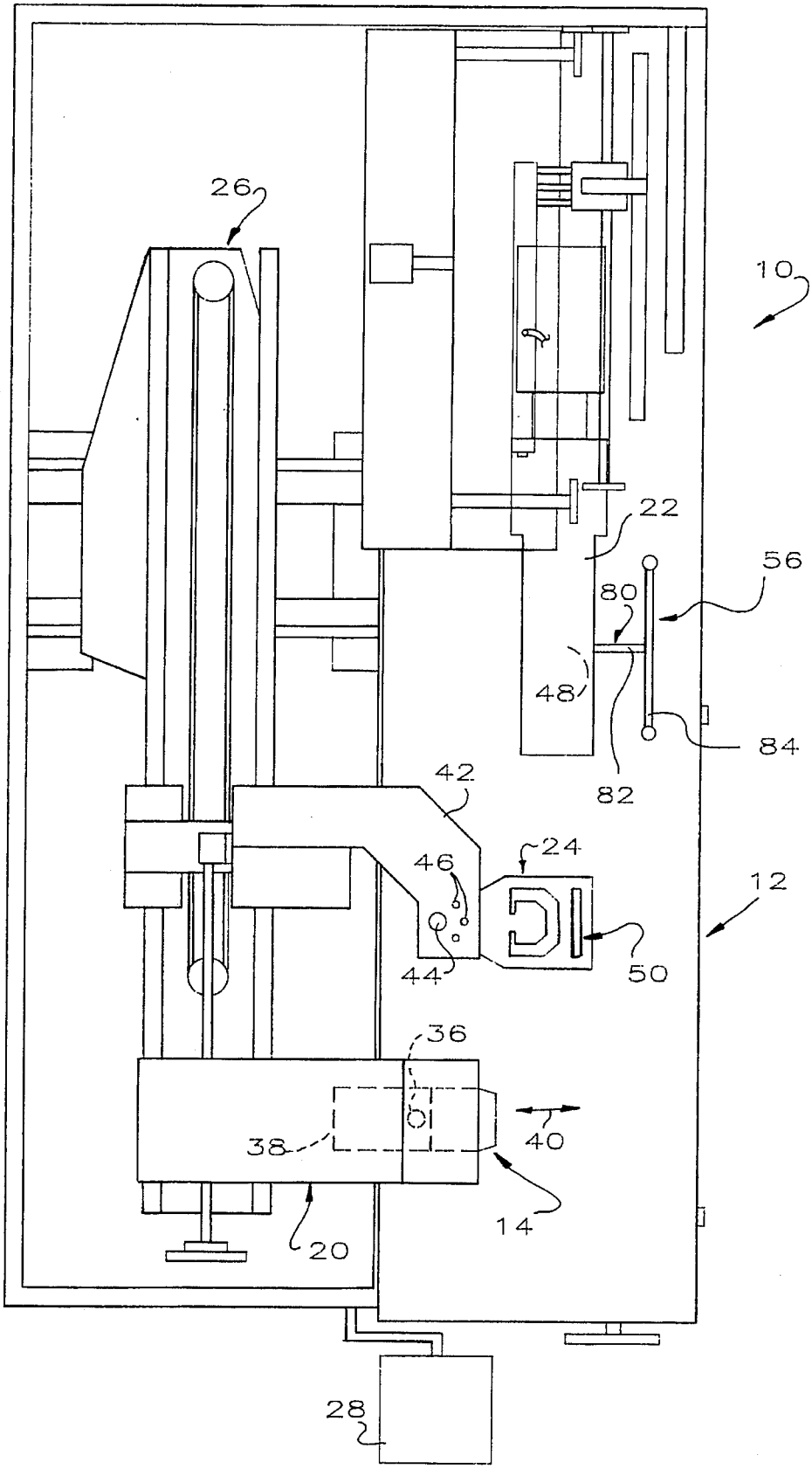
FIG. 1 is a top plan view of a machine of this invention configured to conduct a pocket setting operation.

Referring to FIGS. 1–4, a pocket and pocket flap setting machine 10 of this invention comprises, as major components, a work table 12, a die blade type work holder 14 for receiving a pocket blank 16 above a shirt panel 18, a folding group 20 for tucking the edges of the pocket blank 16 between the die blade 14 and the shirt panel 18, a sewing head 22, a transfer clamp 24 for pushing the pocket blank 16 and shirt panel 18 against the table 12, an x-y positioner 26 for moving the transfer clamp 24 and thereby sliding the pocket blank 16 and shirt panel 18 from the holder 14 toward the sewing head 22 and a digital controller 28 for energizing the various components of the machine 10 at the appropriate times. The work table 12 includes a smooth planar table section 30 which is stainless steel or the like.

Figure 2:
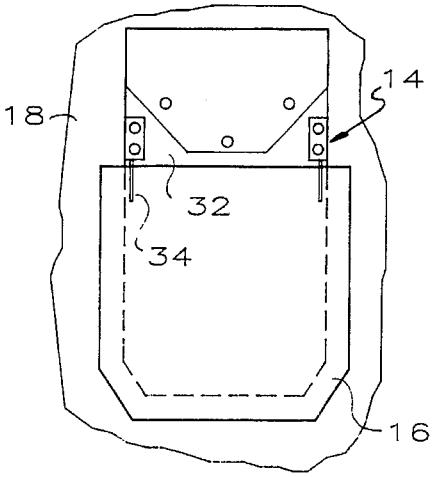
FIG. 2 is a top plan view of a die blade type work holder having a pocket blank thereon.
Figure 3:
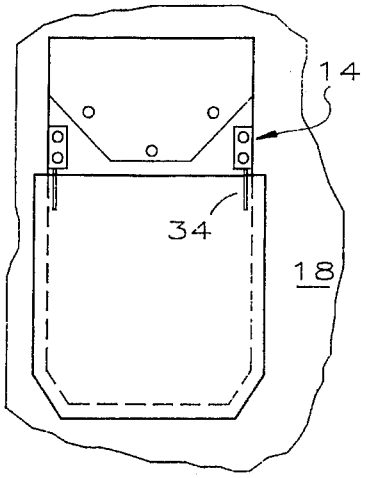
FIG. 3 is a top plan view similar to FIG. 2 showing the pocket blank after the folding group has tucked the edges between the die blade and a shirt panel.
Figure 11:
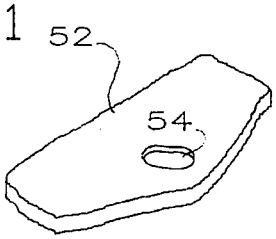
FIG. 11 is an isometric view of a pocket flap.

The die blade type work holder 14 is partially obscured, in FIG. 1 by the folding group 20 and is best shown in FIGS. 2 and 3. The work holder 14 includes a die blade 32 in the shape of the pocket on the finished shirt, a pair of clips 34 to hold the pocket blank 16 against the die blade 32, an air cylinder 36 for raising and lowering the die blade 32 relative to the table top 30 and means 38 for advancing and retracting the die blade 32 parallel to the table top 30 as shown by the arrow 40.

In use, the die blade 32 is extended and raised above the table top 30 so the machine operator can place the shirt panel 18 in a predetermined location on the table top 30 and place the pocket blank 16 in the clips 34 as shown in FIG. 2. The machine operator presses a pair of switch buttons (not shown) that activates the digital controller 28 and initiates a series of events, starting with extending the cylinder 36 and pressing the die blade 14 lightly against the table top 30. Under the control of the digital controller 28, the folding group 20 pivots downwardly over the die blade 32 and tucks the edges of the pocket blank 16 under the die blade 32 as shown in FIG. 3 and then retracts out of the way.

Figure 4:
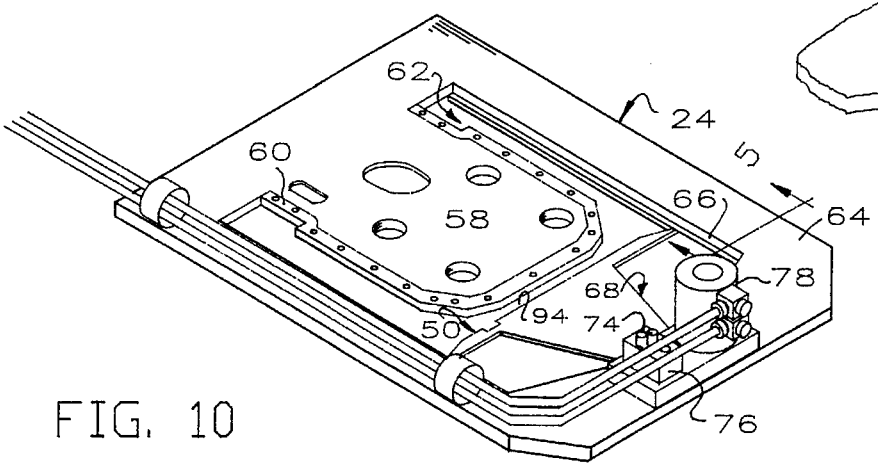
FIG. 4 is an isometric view of a transfer clamp of this invention.

Referring to FIGS. 1 and 4, the x-y positioner 26 includes a transfer arm 42 having an air cylinder 44 and guides 46 mounting the transfer clamp 24 for horizontal and vertical movement. The conventional functions of the transfer clamp 24 are to slide the shirt panel 18 and pocket blank 16 from the work holder 14 to the sewing head 22 and then move the shirt panel 18 and pocket blank 16 under the sewing needle 48 to sew the pocket blank 16 to the shirt panel 18 with a desired stitch pattern. As heretofore described, the pocket setter 10 of this invention will be recognized by those skilled in the art as representative of the pocket setting machines manufactured by the assignee of this invention.

In this invention, the transfer clamp 24 provides a pocket flap holder 50 for receiving a pocket flap blank 52 having a finished lower edge and possibly a button hole or snap 54. The transfer clamp 24, in conjunction with a shirt panel holder 56, the x-y positioner 26 and the sewing head 22, sews the pocket flap blank 52 onto the shirt panel 18 at the end of the pocket setting operation. As will become more fully apparent hereinafter, this is accomplished with a minimum of additional mechanical or electro-mechanical parts and the necessary movement of the pocket flap holder 50 relative to the shirt panel 18 are done by the x-y positioner 26 under the control of the digital controller 28. This means the incremental costs of performing this operation are quite low and there are few components to maintain. In addition, changes in design of the pocket flaps can be readily accommodated with minimum costs because any needed change in movement is done by changing the software instructions in the digital controller 28.

To these ends, the transfer clamp 24 includes a conventional pocket shaped section 58 providing an edge 60 and a gap 62 in the shape of the seam to be sewn. The pocket flap holder 50 is an extension of the transfer clamp 24 and includes a stationary generally U-shaped section 64 having a rigid shoulder 66 and a movable plate 68. As shown best in FIG. 5, the movable plate 68 includes a pair of rigid ends 70 to overlie and captivate the edges of the pocket flap blank 52 and a central foam section 72 for pushing the pocket flap 52 against the table top 30. A vertical guidepost 74 and slide bearing 76 mount the movable plate 68 for vertical movement under the control of an air cylinder 78 which is ultimately controlled by the digital controller 28.

In use, after the edges of the pocket blank 16 have been tucked under the die plate, as shown in FIG. 3, the transfer clamp 24 is moved by the x-y positioner 26 to a location where the machine operator loads the pocket flap 52 into the pocket flap holder 50. This may be accomplished at any convenient location, such as where the transfer clamp 24 is above the die plate 32. After the pocket flap 52 is loaded, the machine operator restarts the pocket setter 10 by pushing a pair of switch buttons (not shown). Under the control of the digital controller 28, the transfer clamp 24 pushes downwardly against the pocket blank 16 and shirt panel 18, the die blade 32 is pulled out of the open top of the pocket blank 16 by the mechanism 38 and the x-y positioner 26 moves the transfer clamp 24 to the sewing location under the needle 48 where the pocket blank 16 is sewn to the shirt panel 18 in a conventional manner, i.e. the x-y positioner 26 moves the shirt panel 18 in a predetermined path to create the desired stitch pattern.

Figure 7:
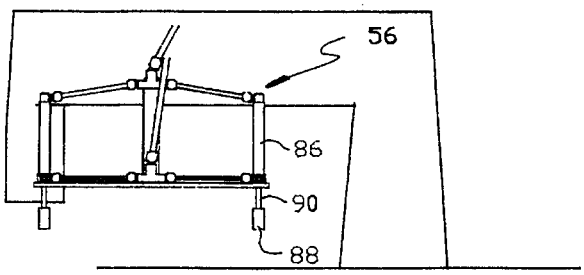
FIG. 7 is a front view of the sewing head, showing the shirt panel holder in a retracted position.

After the pocket blank 16 is sewn to the shirt panel 18, the shirt panel 18 is momentarily immobilized by the shirt panel holder 56. To this end, the shirt panel holder 56 comprises a T-shaped bracket 80 having a leg 82 fixed to the sewing head 22 and a cross-bar 84. A pair of small, long stroke air cylinders 86 each include an output comprising a rubber foot 88 on the end of a piston 90. The pistons 90 are normally retracted so the rubber feet 88 are well above the table top 30 as shown best in FIG. 7. This allows the x-y positioner 26 to move the transfer clamp 24, without interference, in a desired path under the sewing needle 48 to sew the pocket flap 16 to the shirt panel 18.

Figure 6:
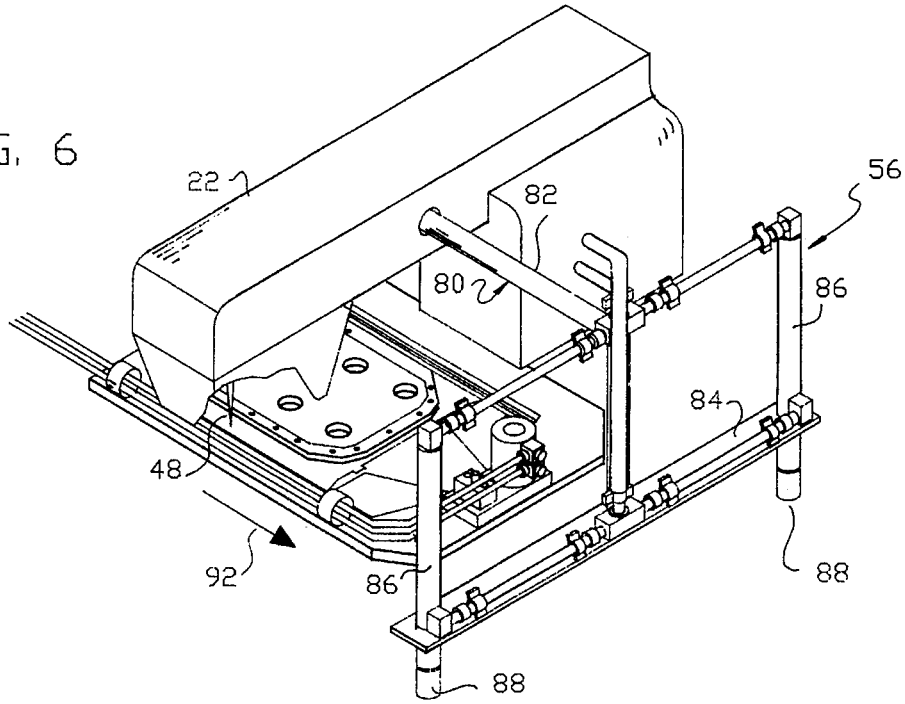
FIG. 6 is an isometric view of the transfer clamp of FIG. 4 and the sewing head showing the pocket being stitched to the shirt panel.
Figure 8:
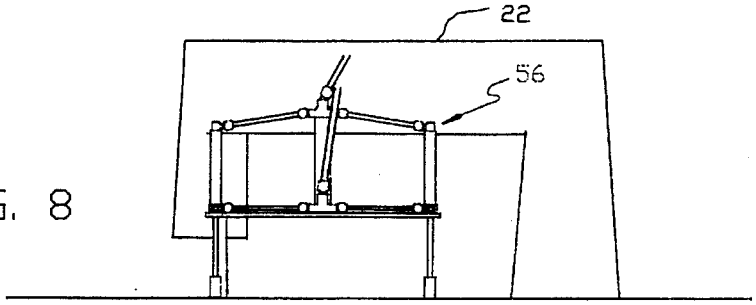
FIG. 8 is a front view of the sewing head, showing the shirt panel holder in an extended position holding the shirt panel against the table top.
Figure 9:
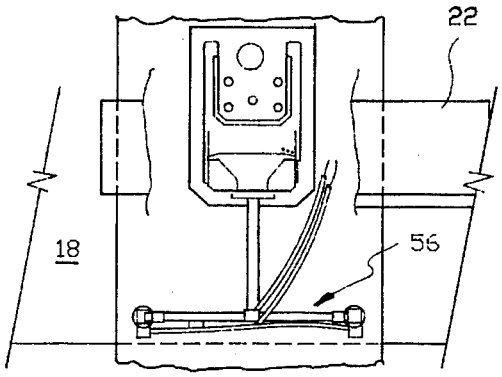
FIG. 9 is a top plan view of the transfer clamp and sewing head, showing the pocket flap in position to be stitched to the shirt panel.

At the end of the pocket sewing operation, the pocket blank 16 is not likely to be positioned in exactly the right place to start sewing the pocket flap blank 52. Thus, the digital controller 28 signals the x-y positioner 26 which moves shirt panel 18 in the direction shown by the arrow 92 as shown in FIG. 6. When the shirt panel 18 is in a position where sewing of the pocket flap blank 52 is to start, the digital controller 18 controls a valve (not shown) to deliver air to the cylinders 86 to extend the rubber feet 88 against the shirt panel 18 thereby pinning the shirt panel 18 to the table top 30 as shown in FIG. 8. This temporarily immobilizes the shirt panel 18. The digital controller 28 signals the valve (not shown) controlling the cylinder 44 thereby raising the transfer clamp 24 relative to the table top 30 and then signals the x-y positioner 26 to move the transfer clamp 24 to a position to begin sewing the pocket flap blank 52 to the shirt panel 18 as shown in FIG. 9 where the sewing head 22 is broken away to expose the transfer clamp. The digital controller 28 opens the valve (not shown) leading to the cylinder 44 which pushes the transfer plate 24 against the shirt panel 18 and table top 30 and then retracts the rubber feet 88 on the end of the piston 90 thereby freeing the shirt panel 18 for movement relative to the table top 30. Thus the outputs, comprising the rubber feet 88 on the ends of respective pistons 90, reciprocate back and forth. At this time, the sewing needle 48 is immediately adjacent the edge 94 of the movable plate 68 where sewing is to be done. The digital controller 28 then starts the sewing head 22 and the x-y positioner 26 to sew the pocket flap blank 52 to the shirt panel 18.

When the pocket flap blank 52 is sewn to the shirt panel 18, the sewing head 22 cuts the thread and the finished shirt panel is removed from the machine 10. While the pocket blank 16 and pocket flap 52 are being sewn to the shirt panel 18, the machine operator is placing another shirt panel 18 under the die blade 32 and placing another pocket blank 16 under the clips 34 in preparation for other machine cycle.

Figure 10:
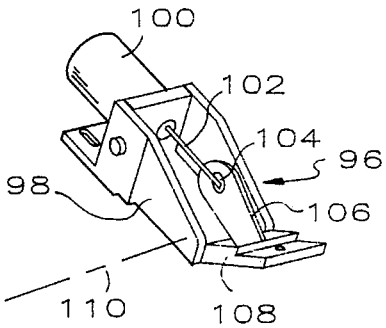
FIG. 10 is a side view of another embodiment of the pocket flap holder of this invention.
Figure 5:
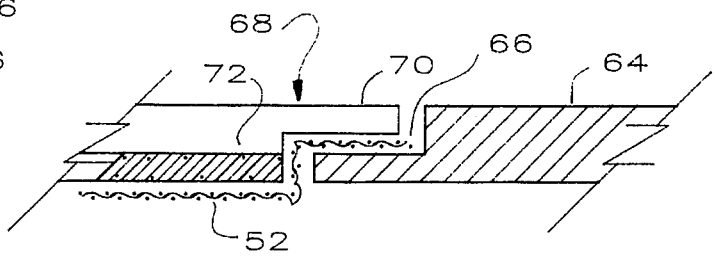
FIG. 5 is an enlarged cross-sectional view of the transfer clamp of FIG. 4, taken along line 5—5 thereof, as viewed in the direction indicated by the arrows.

In the embodiments of FIGS. 4–6, the plate 68 is mounted for vertical movement by the guide post 74 and slide bearing 76. Loading of the pocket flap holder 50 may be more easily accomplished by pivoting the plate 68 relative to the rigid shoulder 66, thereby opening the area for the pocket flap 52. As shown in FIG. 10, an actuator 96 is provided for moving the plate 68 between an operative position abutting the edge 66 and a retracted position allowing easy loading of the pocket flap holder 50. The actuator 96 comprises a base 98, an air cylinder 100 having an output 102 rotatably connected to a post or bearing 104 on an arm 106 connected to a plate 108 mounted for pivotal movement about an axis 110. The movable plate 68 is attached to the plate 108. It will be seen that pivoting the plate 68 allows easy loading of the flap holder 50.

Although this invention has been disclosed and described in its preferred forms with a certain degree of particularity, it is understood that the present disclosure of the preferred forms is only by way of example and that numerous changes in the details of operation and in the combination and arrangement of parts may be resorted to without departing from the spirit and scope of the invention as hereinafter claimed.

I claim:

1. A pocket and pocket flap setter comprising a table having a generally planar section, a work holder for receiving a pocket blank above a shirt panel on the planar section, means for tucking edges of the pocket blank under the pocket blank, a sewing head for sewing the pocket blank to the shirt panel and providing a reciprocable sewing needle defining a sewing location on the table, a transfer clamp for pushing the shirt panel and pocket blank against the table section and providing a pocket shaped section having a first section corresponding to a pocket top and a second section corresponding to a pocket bottom, and an x-y positioner for moving the transfer clamp, the improvement comprising a pocket flap holder on the transfer clamp, means for activating the x-y positioner for moving the transfer clamp in a series of movements including a path from a first position placing the pocket shaped section adjacent the sewing location and a second position placing the pocket flap holder adjacent the sewing location, and means for immobilizing the shirt panel relative to the sewing location after the pocket blank is sewn to the shirt panel and before the x-y positioner moves the transfer clamp in the path to the second position.

2. The pocket and pocket flap setter of claim 1 further comprising means for releasing the shirt panel for movement relative to the sewing location after the x-y positioner moves the transfer clamp to the second position.

3. The pocket and pocket flap setter of claim 1 further comprising means for moving the transfer clamp toward and away from the table and means for activating the moving means for moving the transfer clamp away from the table after the pocket blank is sewn to the shirt panel and then moving the transfer clamp toward the table after the transfer clamp arrives at the second position.

4. The pocket and pocket flap setter of claim 1 wherein the shirt panel fixing means comprises a reciprocating output positioned to abut the shirt panel at the sewing location, means for extending the output after the pocket is sewn to the shirt panel, and means for retracting the output after the transfer clamp arrives at the second position.

5. The pocket and pocket flap setter of claim 4 wherein the shirt panel fixing means comprises a pair of spaced piston-cylinder devices, each of the devices having a reciprocating output positioned to abut the shirt panel, means for extending the output after the pocket is sewn to the shirt panel, and means for retracting the output after the transfer clamp arrives at the second position.

6. The pocket and pocket flap setter of claim 4 wherein the shirt panel fixing means comprises a bracket fixed to the sewing head and means mounting the reciprocating output on the bracket for movement toward and away from the table section.

7. The pocket and pocket flap setter of claim 1 wherein the pocket flap holder is adjacent the second section of the transfer clamp.

8. The pocket and pocket flap setter of claim 1 wherein the pocket flap holder comprises a stationary section having a recess corresponding to the shape of a pocket flap blank, a plate of a shape to abut the recess, means mounting the plate for movement between a first holding position abutting the recess and a second loading position spaced from the recess and means for moving the plate between the first and second positions.

9. The pocket and pocket flap setter of claim 8 wherein the plate mounting means comprises means mounting the plate for linear vertical movement between the first holding position and the second loading position.

10. The pocket and pocket flap setter of claim 8 wherein the plate mounting means comprises means mounting the plate for pivotal movement between the first holding position and the second loading position.

11. A pocket and pocket flap setter comprising a sewing head for sewing a pocket blank to a shirt panel and providing a reciprocable sewing needle defining a sewing location, a transfer clamp providing a pocket shaped section having a first section corresponding to a pocket top and a second section corresponding to a pocket bottom, and an x-y positioner for moving the transfer clamp, the improvement comprising a pocket flap holder on the transfer clamp, means for activating the x-y positioner for moving the transfer clamp in a series of movements including a path from a first position placing the pocket shaped section adjacent the sewing location and a second position placing the pocket flap holder adjacent the sewing location, means for fixing the shirt panel relative to the sewing location after the pocket blank is sewn to the shirt panel and before the x-y positioner moves the transfer clamp in the path to the second position.

12. The pocket and pocket flap setter of claim 11 wherein the pocket flap holder is adjacent the second section of the transfer clamp.

13. The pocket and pocket flap setter of claim 11 further comprising means for releasing the shirt panel for movement relative to the sewing location after the x-y positioner moves the transfer clamp to the second position.

14. The pocket and pocket flap setter of claim 11 further comprising a table having a planar section, means for moving the transfer clamp toward and away from the table, and means for activating the moving means for moving the transfer clamp away from the table after the pocket blank is sewn to the shirt panel and then moving the transfer clamp toward the table after the transfer clamp arrives at the second position.

15. The pocket and pocket flap setter of claim 14 wherein the shirt panel fixing means comprises a reciprocating output positioned to abut the shirt panel at the sewing location, means for extending the output after the pocket is sewn to the shirt panel, and means for retracting the output after the transfer clamp arrives at the second position.

16. The pocket and pocket flap setter of claim 15 wherein the shirt panel fixing means comprises a pair of spaced piston-cylinder devices, each of the devices having a reciprocating output positioned to abut the shirt panel, means for extending the output after the pocket is sewn to the shirt panel, and means for retracting the output after the transfer clamp arrives at the second position.

17. The pocket and pocket flap setter of claim 15 wherein the shirt panel fixing means comprises a bracket fixed to the sewing head and means mounting the reciprocating output on the bracket for movement toward and away from the table section.

* * * * *